United States Patent [19]

Bradley et al.

[11] Patent Number: 5,042,405

[45] Date of Patent: Aug. 27, 1991

[54] YARN CONTROL METHOD AND APPARATUS

[75] Inventors: Paul J. Bradley; David J. Burton; Leslie F. Voss, all of Kidderminster, United Kingdom

[73] Assignee: Tomkinsons Plc, United Kingdom

[21] Appl. No.: 520,289

[22] Filed: May 7, 1990

[30] Foreign Application Priority Data

May 9, 1989 [GB] United Kingdom ..... 8910632

[51] Int. Cl.[5] ..... D05C 15/04; D05C 15/08

[52] U.S. Cl. ..... 112/7; 112/80.01; 112/266.2

[58] Field of Search ..... 112/7, 8, 410, 266.2, 112/80.01, 80.3, 9, 80.7, 80.5; 28/103, 159, 160, 214

[56] References Cited

U.S. PATENT DOCUMENTS

| | | | |
|---|---|---|---|
| 2,747,534 | 5/1956 | Piper et al. | 112/266.2 |
| 2,908,013 | 10/1959 | Keen et al. | 112/266.2 |
| 3,112,721 | 12/1963 | Oberholtzer et al. | 112/266.2 |
| 3,203,378 | 8/1965 | Dedmon | 112/266.2 |
| 3,359,934 | 12/1967 | Schwartz et al. | 112/266.2 |
| 3,393,653 | 7/1968 | Ellison | 112/266.2 |
| 3,396,687 | 8/1968 | Nowicki | 112/266.2 |
| 3,416,471 | 12/1968 | Ellison et al. | 112/410 |
| 3,421,929 | 1/1969 | Watkins | 112/266.2 |
| 4,062,308 | 12/1977 | Spanel et al. | 112/266.2 |

FOREIGN PATENT DOCUMENTS

| | | | |
|---|---|---|---|
| 3165568 | 7/1988 | Japan | 112/7 |

*Primary Examiner*—Werner H. Schroeder
*Assistant Examiner*—Sullivan C. Prak
*Attorney, Agent, or Firm*—Silverman, Cass & Singer

[57] ABSTRACT

A yarn control system and apparatus for use in the manufacture of non-woven, non-knitted fabrics which have a pile supported by a backing cloth, such as carpets, the apparatus including a plurality of needles for inserting yarns from yarn supplies into the backing cloth to provide a pile material and control means for controlling the amount of each yarn inserted by the needles to maintain constant pile height, the control means including a yarn compensating roller upstream of the needles and around which each yarn is entrained, and biassing means acting on the roller to maintain a constant tension in the yarns, the biassing means preferably comprising pneumatic piston and cylinder devices. The compensating roller may have a roughened surface and is preferably able to rotate in one direction only, but in an alternative construction, a driven guide roller which has a roughened surface is provided and the compensating roller has a smooth surface.

19 Claims, 4 Drawing Sheets

YARN CONTROL METHOD AND APPARATUS

BACKGROUND OF THE INVENTION

1. Field of the Invention

This invention relates to a yarn control system and apparatus for use in the manufacture of non-woven, non-knitted fabrics which have a pile supported by a prewoven or non-woven backing cloth. The invention is particularly suitable for use with yarn feed systems of cut-pile and loop-pile, straight, single sliding, staggered and double sliding needle bar tufting machines, especially carpet tufting machines.

2. Description of the Prior Art

Most pile fabrics are manufactured on tufting machines which incorporate needle bars extending transversely of the length of fabric to be formed, and the needle bars have a plurality of needles therein, and are caused to move up and down at high speed, so as to force the needles thereon through a pre-woven backing cloth which is advanced in the longitudinal direction of the fabric. A yarn from a supply is fed by a feed roller arrangement to each needle, and as soon as the needles have been inserted through the backing cloth, a looper/hook engages with the yarn, thus forming a loop of yarn when the needle is withdrawn again. This forms a loop pile, but if a cut pile is required, the loop is held by a looper and is subsequently cut.

In order to obtain a smooth surface to the pile material, each loop or cut length should be of the same height and the tufting machines are designed with this in mind. However, if the tension in the yarn from its supply to its needle varies, a level pile is unlikely to result, because any loop or cut length of yarn, formed from a yarn under high tension, once it is supported in the backing cloth, will tend to shrink and thus will eventually be too short. In contrast to this, the loop or cut length of yarn may be too long if there was low yarn tension when the needle inserted it in the backing cloth.

When it is desired to form a patterned fabric, different yarns are used, e.g. of different colours, and a pattern is achieved by moving the needle bar axially, or by moving the backing cloth transversely relative to the needle bar, so that the loops of pile being inserted into the advancing backing cloth are shifted transversely, resulting in a diagonal stitch on the back of the backing cloth. The distance between needles on a needle bar can be of the order of 1/20" to ⅜", and is known as gauge. It is possible to shift needle bars by one, two or perhaps more gauges and a two gauge movement is known as double gauge movement. This means that in such instances, more yarn will be required, because the pieces of yarn to be formed into such loops will still be attached to the backing cloth as a result of the previous loop (or cut length) having been formed. This is likely to mean that when such a loop is formed, for example, after a single gauge movement, it will be formed with the yarn under greater tension than a straight loop. Likewise, when a loop is formed after a double gauge movement of the needle bar, the yarn is likely to be under even greater tension.

The above described machines have yarn feed systems which cannot really cope with the requirement for different yarn lengths when the needle bars are shifted axially. They are set up so that the yarn feed is set somewhere between the smallest and the largest amount required. This means that on some stitches or loops, the yarn is fairly slack when it is engaged by the looper/- hook, and on others it is very tight. This shows itself in the finished pile material as an uneven surface, because some rows of pile material, e.g. cut lengths or loops, are too long, and others are too short. To some extent, the problem can be reduced by shearing the surface of the pile. However, this does not fully solve the problem. Excessive shearing would result in considerable yarn wastage, but in practice the problem is still there because of the differential height between adjacent tufts results in high tufts overlying lower tufts during shearing, thus preventing constant presentation of the tufts to the shearing blades.

This means that pile materials, and especially tufted carpets, formed on existing tufting machines, and especially patterned pile material, end up with ugly lines (movement/shift/cam lines) across their surface from the uneven heights of the rows of pile.

Similar problems can also result because those rows of yarn which are inserted with the yarn under too much tension will cause the backing cloth to be deformed slightly, forming slight ridges transversely of the cloth. This again forms ridges and troughs in the finished surface of the carpet, and known as the cam movement or shift line effect.

Furthermore, when rows of yarn are inserted under tension, the weft of the backing cloth can be strained, and can reduce the dimensional stability of the backing cloth.

Lines across the surface, or at least spasmodic differences in pile height, can also result if different yarns are under different or varying tensions, for whatever reason. It will be readily apparent that even in plain pile materials, the tension under which the loop is formed can eventually result in cut or looped lengths of pile being of different heights.

SUMMARY OF THE INVENTION

The present invention seeks to overcome the above disadvantages, and to provide a method and apparatus for controlling yarn feed to the needles of a tufting machine, so as to improve the appearance and quality of the pile material produced by the machine. The invention also enables greater flexibility in design, because within reason, the needle bar can be moved as far as the design dictates.

The yarn control system and apparatus of the invention allows at all times just the correct amount of yarn to be taken from the feed roller via the needles to the hooks/loopers by equalizing the tension of yarn and giving the required pile height for each stitch.

According to the present invention, we provide, in a textile forming machine in which individual yarns from a supply are inserted with the aid of needles into a woven backing cloth to provide a pile material, control means for controlling the amount of each yarn which is inserted by the needles into the backing cloth, so that the height of the pile can be maintained constant across the whole area of the pile material, said control means including a yarn compensation roller adapted to be located upstream of the needles and over which every yarn is entrained, and biassing means acting on the roller to maintain a constant tension on the yarns.

Also according to the present invention, we provide a method of controlling the correct amount of yarn to be inserted into a woven backing cloth by the needles of a machine for forming a pile material, so as to provide a constant pile height in the material, comprising feeding yarn to each needle of the machine at the desired rate from supplies of yarn, and inserting the needles with yarn threaded therein into a woven backing cloth as the latter is fed through the machine and forming said yarn into loops extending through the backing cloth to form the pile including the step of entraining each yarn over a compensating roller upstream of its needle and subjecting the roller to a predetermined biassing force, thereby ensuring that yarn tension is maintained constant during each loop forming operation.

Preferably, the compensating roller is mounted in bearings supported on linear bearing slides, and biassed to its desired position by pneumatic cylinders. By using pneumatic cylinders, the biassing force on the roller can easily be adjusted for different yarns.

The compensating roller may be covered in a grip material, or has a roughened surface, and is preferably constrained to rotate in one sense only by a sprag clutch, thus allowing the yarns to be advanced over the roller each time the needles are inserted into the backing cloth to form a loop, but preventing the yarns from running back when the needles are withdrawn.

It is preferred that a dropper is provided for each individual yarn, so that if any yarn breaks, the dropper for that yarn will drop, as a result of the loss of yarn tension, breaking a light beam, and thereby stopping the machine. The droppers are bell crank shaped levers mounted on the machine frame, so located that one arm of the lever would drop into a light beam breaking position were it not for their associated yarns which are threaded through an aperture in their other arm, so that when the yarn is tensioned, they cannot drop. It has been found that the provision of the grit covered compensation roller between the droppers and the needles, spring biassed to provide even yarn tension at the needles, resulted in such a large reduction in yarn tension upstream of the roller (yarns are continuously drawn off their supply creels by being passed around a series of roughened driven feed rollers) that sometimes a dropper would "drop" (due to little or no yarn tension) and hence stop the machine. To overcome this problem, the biassing force acting on the roller was increased to ensure tension on the yarns upstream of the roller at all times. However, this was counterproductive, as it also increased yarn tension downstream of the roller, i.e. at the needles, which the invention is intended to prevent.

Hence, to solve this problem, it is preferred that the surface of the compensating roller is smooth, and a guide roller be provided, upstream of the compensating roller, which is driven to maintain yarn tension, and preferably provided with a grit paper or other roughened surface. In this way, it is possible to maintain only a low pressure in the pneumatic biassing cylinders, e.g. of the order of 10–15 p.s.i. (689.5–1034.2 mbar).

While it is preferred to bias the cylinders pneumatically, problems have occurred due to the continuous reciprocating motion of the pistons associated with the cylinders as the yarn tension at the needles is compensated. This has meant that the pistons have tended either to move to a fully extended position, thus putting too much tension on the yarn(s), or to a fully retracted position, with the result that insufficient tension is put on the yarn(s). The precise reason for this is unknown. One way to overcome the problem is by pressurizing the cylinders from two different pressure sources, one higher than the other, and provide sensing means to sense the movement of the compensating roller, so that when the roller moves too far in one direction due to too much pressure being applied to the cylinder, the sensing means will cause the source of pressure to be changed, so that the cylinders are subjected to a slightly lower pressure. A differential of about 1.5 p.s.i. (103.4 mbar) has been found to be satisfactory. Preferably, the sensing means comprises a metal upstand on the bearing support of the roller, and a pair of proximity switches on the frame. Preferably, further proximity switches are provided on either side of the first mentioned proximity switches, which act as safety devices in the event that the roller moves beyond either of the first mentioned switches, which further switches, if activated, will switch off the machine.

It has been found that the biassing cylinders are susceptible to wear and an alternative to using standard cylinders and two alternative pressure sources as described above, is to use low friction glandless cylinders.

BRIEF DESCRIPTION OF THE DRAWINGS

The invention is now described by way of example with reference to the accompanying drawings.

DESCRIPTION OF THE PREFERRED EMBODIMENTS

Figure 1:
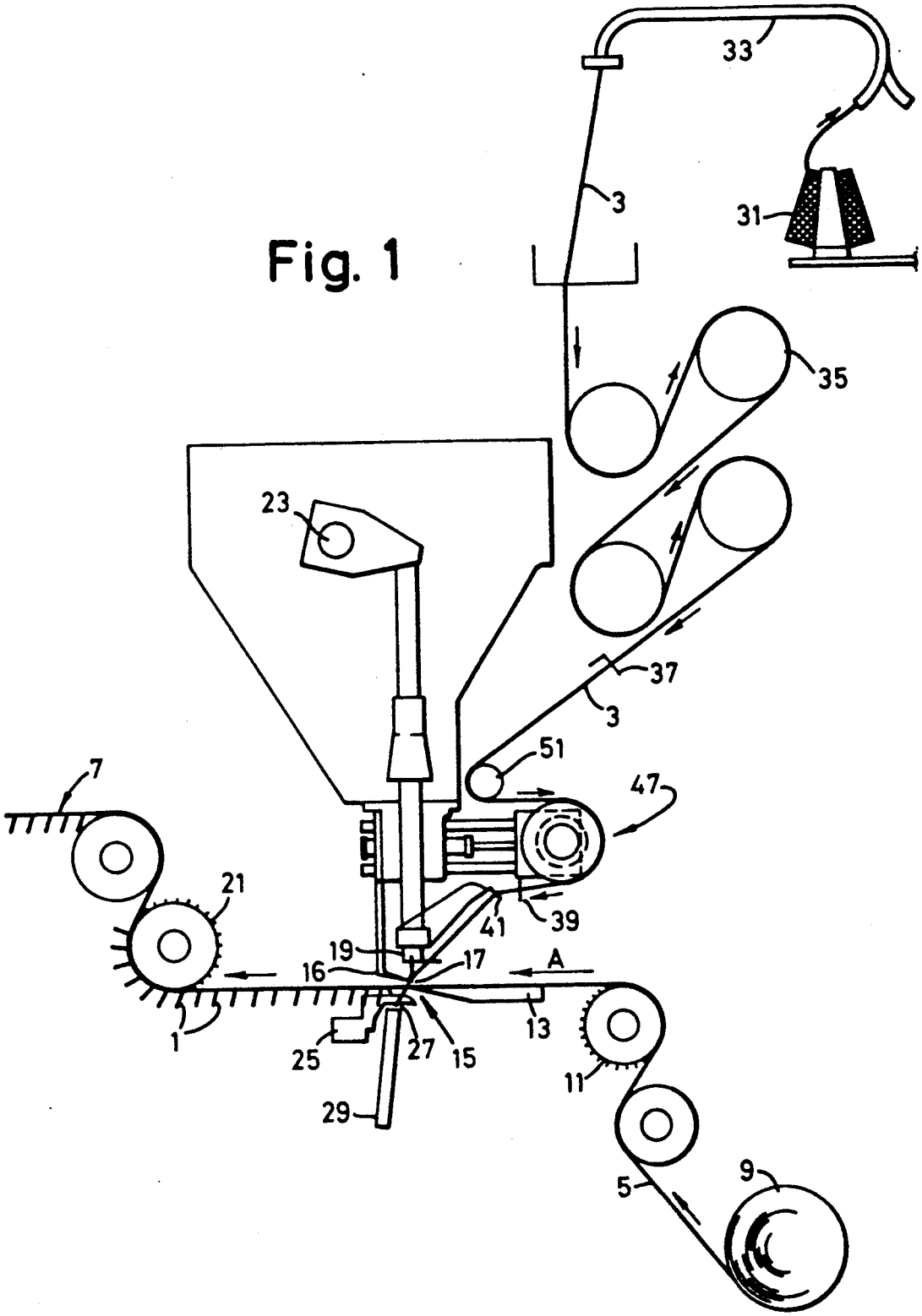
FIG. 1 is a partly schematic, side elevation of a carpet tufting machine, with parts omitted for the sake of clarity, incorporating the invention.

Referring first to FIG. 1, the tufting machine shown therein is for inserting tufts 1 of yarn 3 into a woven backing cloth 5 to provide a loom state cloth 7 which will eventually be a tufted carpet. The woven backing cloth 5 is advanced in the direction of the arrow A from a supply roll 9 by a spiked drive roller 11, over a reed plate 13 to a tufting station 15, where a row of tufts 1 are inserted into the cloth 5 by a plurality of needles 17 carried by a needle bar 19. The loom state cloth 7 is then carried away from the station 15 beneath a presser bar 16 for subsequent storage and/or processing, by a further spiked roller 21.

The needle bar 19 is caused to reciprocate vertically in known manner by an eccentric drive shaft 23, and as the loops of yarn 3 threaded through each needle 17 are tufted into the advancing backing cloth 5, and taken by the needles through the cloth, they are engaged by a looper/hook 25 to form them into a loop 27. If a loop pile carpet is required, the loops 27 are left as loops after withdrawal of the needles 17 (and a different looper/hook configuration is used), but if a cut pile is required, each loop is severed by a knife 29 to provide a tuft of yarn.

The yarn 3 is fed in known manner from a supply creel 31, through a yarn guide tube 33 by feed rollers 35 to its needle 17, through a plurality of yarn guides some of which are shown in FIG. 1 at 37, 39, 41. However, in accordance with the invention, the yarn is fed over a compensating or tensioning roller device 47 to ensure that each cut length or loop of pile 1 is of the same height.

The needle bar 19 is designed to move laterally (of the backing cloth) and along its length to enable a patterned pile fabric to be formed. Although in other constructions of machine the needle bar could be fixed axially (and optionally, for patterned fabric, the backing cloth can be moved transversely) normally, the needle bar will be movable by one, two or three gauges (a gauge is the distance between needles on the bar), and when this happens, the tension in the yarn will be altered. Other factors can change yarn tension, and any alteration in yarn tension will result in the length of yarn inserted into the backing cloth 5 by the needle 17 deviating from the desired length (or height). This results in an uneven pile height, and usually, in lines appearing across the width of the pile fabric, which is undesirable. The roller device 47 ensures substantially constant yarn tension for the yarns at every needle 17 (i.e. at the sheet of yarns) at all times by compensating for gauge movements and ensures that only the correct length of yarn is taken by the needles. This results in an even height pile.

Figure 3:
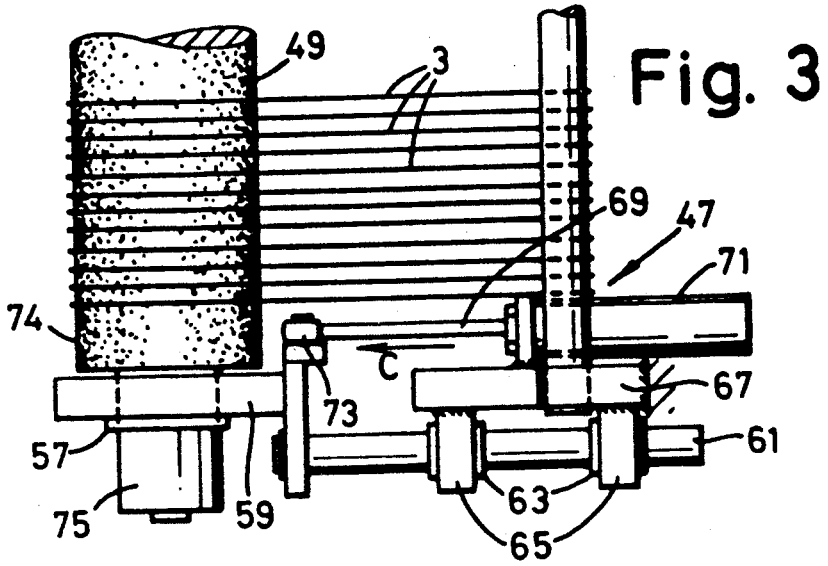
FIG. 3 is a plan view of one end of the device shown in FIG. 2.
Figure 2:
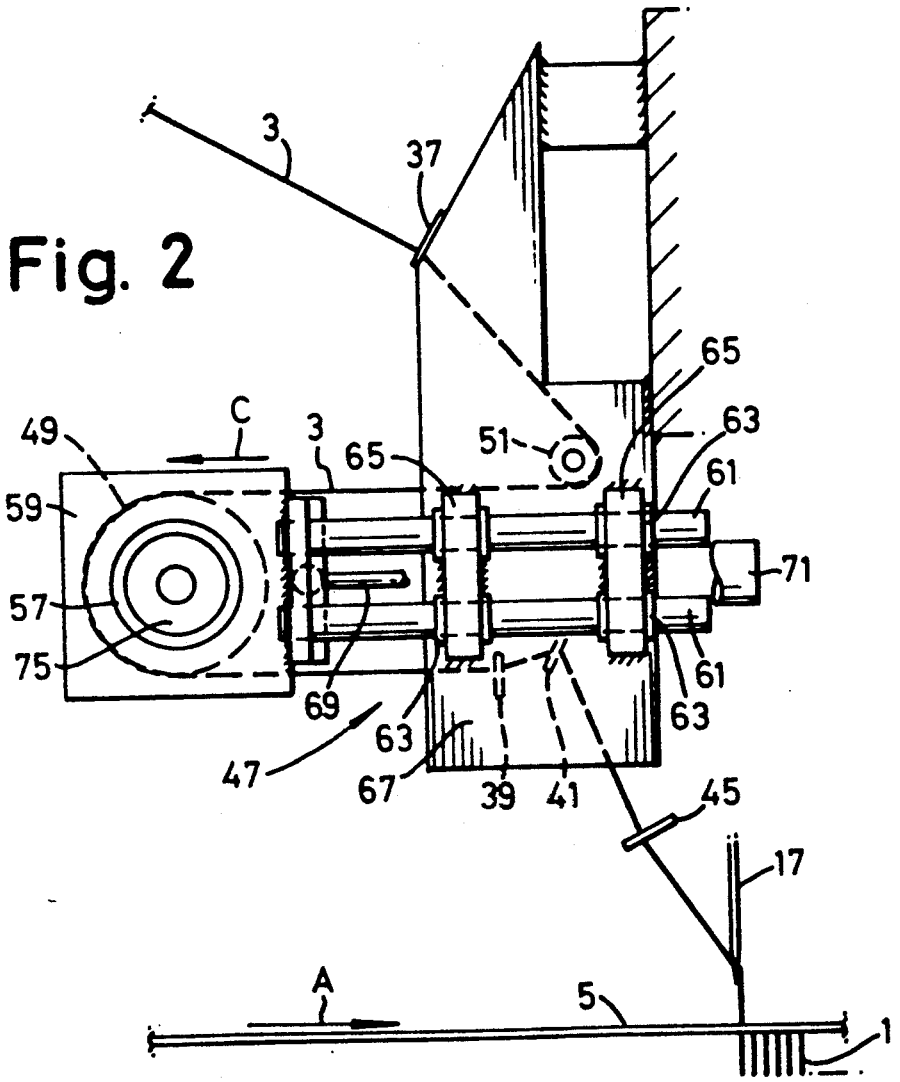
FIG. 2 is an enlarged partly sectional side elevation of a yarn compensating device incorporated in the machine of FIG. 1 but viewed from the opposite end of the machine compared with FIG. 1.

Referring now to FIGS. 2 and 3, the compensating or tensioning roller device 47 comprises a roller 49 extending across the width of the machine and around which each yarn 3 is entrained, after passing around a guide roller 51. The yarns then pass through the yarn guides 39 and 41 and then a further guide 45 (not shown in FIG. 1) before being threaded through the needle 17. The roller 49 is supported at each end in a roller bearing 57 carried by an L-shaped bracket 59 which is supported on a pair of linear slides 61 which are slidably supported in slide bearings 63 carried by spaced brackets 65 supported on the machine frame 67. A piston rod 69 of a pneumatic piston/cylinder device 71 also supported by the frame 67 is connected to the L-shaped bracket 59 at 73, and by adjusting the pressure within the piston/cylinder device 71, a biassing force in the direction of the arrow C is applied to the roller 49. This biassing force can be adjusted to suit different yarns, and ensures that the yarns entrained around the roller 49 are fed to their needles 17 at a constant tension at all times.

The roller 49 has a roughened surface, e.g. of grit paper 74, and is able to rotate in one direction only (to allow the yarns 3 to be advanced), a roller sprag clutch 75 or the equivalent being provided to prevent rotation in the opposite direction. This ensures that at no time can the tension in the yarns between the roller 49 and their supply creels 31 cause a "pull back" of yarn from the needle 17.

Figure 4:
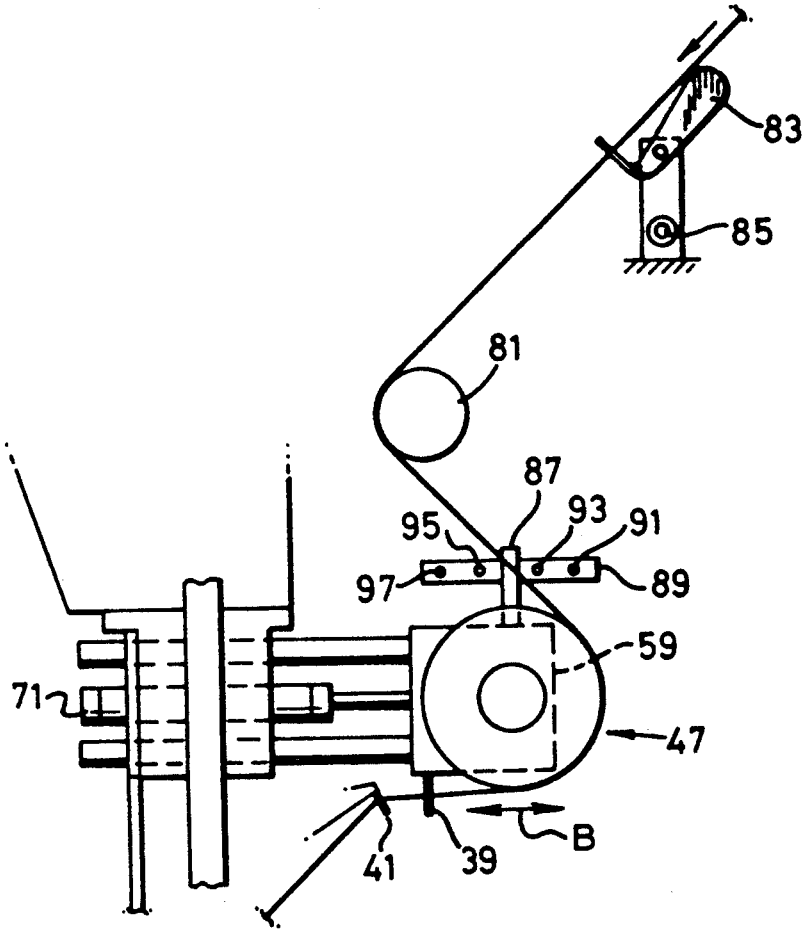
FIG. 4 is a partly schematic side elevation of part of the carpet tufting machine shown in FIG. 1 showing a modified construction in the vicinity of the yarn compensating device.
Figure 5:
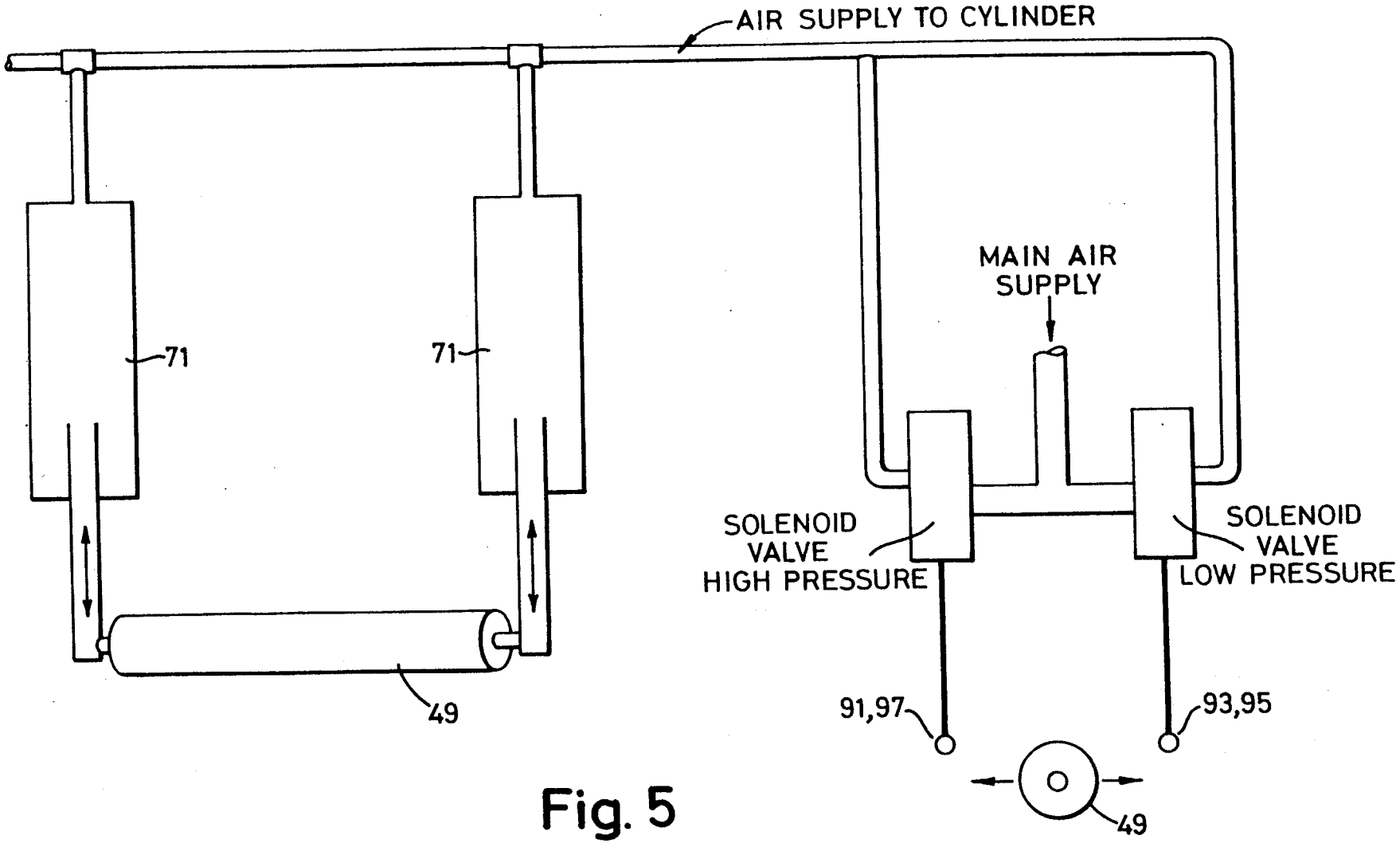
FIG. 5 illustrates the air supply system for the piston/cylinder devices used for the tufting machines.

In the modified construction shown in FIG. 4, the guide roller 51 is replaced by a driven roller 81 which may be in the same location as the roller 51 shown in FIG. 1 but is preferably located at a higher level than the roller 51 to assist the setting up or maintenance of the machine. In the FIG. 1 construction it was important that the bottom of the roller 51 should be approximately in line with the top of the compensating roller 49 because the roller 49 had a roughened surface and it was important to obtain as much wrap of yarn as possible around the surface of this roller. However, in the FIG. 4 construction, the compensating roller 49 has a smooth surface which means that maximum yarn wrap is not so important. In the FIG. 4 construction, each yarn passes through a dropper 83, of known construction, which is located between the roller 81 and the yarn guides 37. These droppers each comprise bell crank shaped levers pivotally supported on the machine frame, there being an eye in one arm of the bell crank lever through which the yarn passes and a thickened portion on the end of the other arm of the bell crank lever, and the geometry of the bell crank levers is such that should the particular yarn passing through the dropper 83 break, then the dropper 83 will pivot under the force of gravity from the position shown so that its other arm will swing down into the path of a beam of light, shown schematically at 85, so as to break the light beam, thus switching off the machine. In this way, should any yarn break on the machine, there is almost instant machine shut-off thus ensuring that the minimum amount of sub-standard tufted fabric is manufactured. Because the driven roller 81 has a roughened surface, there is always tension in each yarn between the roller 81 and the normal yarn feed rollers 35, regardless of the tension of the yarn between the roller 81 and the needles 17, thus ensuring that there is no inadvertent machine shut off due to a dropper 83 swinging to a light beam breaking position as a result of a fall in tension of yarn between the roller 81 and feed rollers 35. It has been found that such drop in tension does occur under certain operating conditions in the construction shown in FIGS. 1–3.

In the construction shown in FIG. 4, each pneumatic piston and cylinder device 71 is selectively fed from two different air supplies via solenoid valves, one being at a slightly higher pressure than the other. This is so as to prevent excessive movement of the compensating roller 49 due to a build up or reduction in pressure in the cylinder 71. The amount of air supplied from the different pressure sources to the piston and cylinder device 71 is responsive to the linear movement of the roller 49 and for this purpose the bearing support or L-shaped bracket 59 supporting one end of the roller 49 has an upstanding metal finger 87 thereon which is slidable to and fro in the direction of the arrows B dependent upon the pressure in the cylinder 71. Supported on the machine frame closely adjacent the path of movement of the finger 87 is a support bracket 89 on which four spaced proximity switches 91, 93, 95 and 97 are located, the switches 91, 93, 95 and 97 being actuated by finger 87. Under normal operating conditions, the finger 87 will be allowed to move just between the switches 93 and 95. When the roller 49 is sidingly shifting to the right (as viewed in FIG. 4) by the pressure in the cylinder 71 to such an extent that the finger 87 moves to a position in which it influences the switch 93, this will cause a pneumatic switch to change the pressure supply in the cylinder 71 from the high pressure source to a slightly lower pressure source. The pressure within cylinder 71 will then be slightly lower thus causing a contraction of the device 71 with the result that the roller will tend to move to the left, as shown in FIG. 4, thereby slightly reducing the tension of the yarn entrained around the roller. The pressures of the two air supplies are arranged respectively slightly above and slightly below the ideal pressure so that once air is supplied to the cylinder 71 at the lower pressure, the roller will tend to continue to move to the left until the finger 87 moves to a position in which it influences the proximity switch 95. This will immediately cause a further switching operation to be performed to cause a switching over to the higher source of air pressure, with the result that the roller 49 will tend again to move to the right, as shown in FIG. 4. In this way, excessive extension or retraction of the piston and cylinder device 71 is avoided and a relatively uniform compensating force is maintained on the yarns entrained around the roller 49. The two further proximity switches 91 and 97 located towards the extremities of the support 89 are provided for safety purposes in case of a malfunction of the switches 93 and 95, and should the finger 87 move to a position in which it will influence either of the further switches 91 or 97 this will immediately cause a shut down of the machine.

As an alternative to using standard cylinders and two different pressure sources, we have found that using cylinders of glandless construction is very satisfactory. Cylinder wear due to the constant reciprocation of the piston within the cylinder, due to the continuous "hunting" of the roller 49 to achieve the correct yarn compensating tension, is avoided. Each glandless piston/-cylinder device has its piston pivotally connected to the bracket 59 supporting the roller bearing 57, and at its opposite end, the cylinder of the device is pivotally connected to the machine frame 67. A threaded connection between the piston pivot and the end of the piston slidable in the cylinder is provided for adjustment purposes.

By maintaining yarn tension substantially constant for each needle 17 at all times, it is possible to ensure that the right length of yarn is inserted by the needles each time a tuft is formed, and this results in a constant height pile in the fabric being formed. This in turn means that in the case of cut pile, when the finished woven fabric is sheared, only an absolute minimum of pile material need be removed.

In some instances, a shearing step may even be omitted. This means that the finished fabric does not have unsightly transverse lines therein, and especially in the case of tufted carpets, a very high quality carpet results.

The yarn tensioning methods and apparatus described above are relatively inexpensive and simple to manufacture, and could be supplied with any pile fabric tufting machine, and/or retro-fitted to existing machines considerably to improve the quality of the fabric produced by the machine. This is in contrast to known devices, most of which attempt to control yarn tension by providing a controlled drive to the yarn feed rollers. Such equipment is very expensive.

Although this invention has been particularly developed for the manufacture of tufted carpets, it is applicable to other tufting machines for manufacturing pile fabric.

It will of course be understood that the present invention has been described above purely by way of example, and modifications of detail can be made within the scope of the invention. For example, for broad loom carpet manufacture, the roller 49 would probably be divided into several short roller sections, to each of which a biassing force would be applied by a piston/-cylinder device at each end of the roller section.

What is claimed is:

1. A textile forming machine including a plurality of needles for inserting individual yarns from supplied of yarn into a woven backing cloth to provide a pile material, and control means for controlling the amount of each yarn which is inserted by the needles into the backing cloth, so that the height of the pile can be maintained constant across the whole area of the pile material, said control means including a yarn compensating roller adapted to be located upstream of the needles and wherein every yarn is entrained over the roller, and biasing means acting on the roller to maintain a constant tension on the yarns.

2. Control means for controlling the amount of yarn used in a textile forming machine by a plurality of needles each fed with yarn from a supply of yarn, so that the height of the pile of the textile material formed by the machine is constant, the control means including a yarn compensating roll member adapted to be located upstream of the needles and wherein every yarn is entrained over the compensating roll member, and biasing means acting on the compensating roll member to maintain a constant tension on the yarns.

3. A textile forming machine according to claim 1 wherein bearings are provided to support the compensating roller and including linear bearing slides supporting pneumatic cylinders.

4. A textile forming machine according to claim 1, comprising a sprag clutch constraining the compensating roller to rotate in one direction only, thus allowing the yarns to be advanced over the roller each time the needles are inserted into the backing cloth to form a loop, said sprag clutch preventing the yarns from running back when the needles are withdrawn.

5. A textile forming machine according to claim 1, including a covering of grip material on the surface of the compensating roller for gripping the yarn entrained thereover.

6. A textile forming machine according to claim 5 including a freely rotating smooth surfaced guide roller upstream of the compensating roller over which the yarns pass.

7. A textile forming machine according to claim 4 including a driven guide roller which has roughened surface over which said yarns pass before passing around the compensating roller which has a smooth surface, said roughened surface acting to maintain tension of the yarn which passes thereover.

8. A textile forming machine as claimed in claim 7, and comprising a dropper for each individual yarn through which the yarn passes before passing around the driven guide roller, said dropper acting to interrupt the operation of the machine in the event a yarn passing therethrough breaks.

9. A textile forming machine according to claim 1, wherein the biassing means acting on the roller comprises two different sources of air pressure, a pair of piston/cylinder devices, conduit means connecting said two sources of air pressure to said devices and means responsive to the position of the roller to cause switching of the connecting conduit means from one source of air pressure to the other.

10. A textile forming machine according to claim 1 wherein the biassing means acting on the roller is provided by air pressure within a pair of glandless piston/-cylinder devices located between the roller and a frame of the machine.

11. A method of controlling the correct amount of yarn to be inserted into a woven backing cloth by the needles of a machine for forming a pile material, so as to provide a constant pile height in the material, comprising feeding the yarn by yarn feeding means to each needle of the machine at the desired rate from supplied of yarn retained in yarn creels, inserting the needles with the yarn threaded therein into a woven backing cloth as the latter is fed through the machine, forming said yarn into loops extending through the backing cloth to form the pile, entraining each yarn over a compensating roller located upstream of the needles and subjecting the roller to a predetermined biassing force, thereby ensuring that yarn tension is maintained constant during each loop forming operation.

12. Control means according to claim 2 wherein bearings are provided to support the compensating roll member and including linear bearing slides supporting said bearings, said biassing means comprising a pair of pneumatic cylinders.

13. Control means according to claim 2 comprising a sprag clutch constraining the compensating roll member to rotate in one direction only, thus allowing the yarns to be advanced over the compensating roll member each time the needles are inserted into the backing cloth to form a loop, said sprag clutch preventing the yarns from running back when the needles are withdrawn.

14. Control means according to claim 2 including a covering of grip material on the surface of the compensating roll member for hindering relative motion between said compensating roll member and yarn entrained around said compensating roll member.

15. Control means according to claim 14 including a freely rotating smooth surfaced guide roller upstream of the compensating roll member over which the yarns pass.

16. Control means according to claim 13 including a driven guide roller which has a roughened surface over which said yarns pass before passing around the compensating roll member, which has a smooth surface, said roughened surface being to reduce relative motion between the yarns and the driven guide roller.

17. Control means as claimed in claim 16 including a plurality of droppers through which said yarns pass before passing around the driven guide roller wherein each dropper acts to interrupt the operation of the machine in the event the yarn passing therethrough breaks.

18. Control means according to claim 2 wherein the biassing mean acting on the compensating roll member comprises two sources of air pressure, a pair of piston/-cylinder devices, conduit means connecting said two sources of air pressure to said devices, and sensing means responsive to the position of the compensating roll member to cause switching of the connecting conduit means from one source of air pressure to the other.

19. Control means according to claim 2 wherein the biassing means is provided by air pressure within a pair of glandless piston/cylinder devices located between the compensating roll member and a frame of the machine.

* * * * *

UNITED STATES PATENT AND TRADEMARK OFFICE

CERTIFICATE OF CORRECTION

PATENT NO. : 5,042,405

DATED : August 27, 1991

INVENTOR(S) : Paul John Bradley, David John Burton and Leslie Frederick Voss

It is certified that error appears in the above-identified patent and that said Letters Patent is hereby corrected as shown below:

Column 1, line 9, change "prewoven" to --pre-woven--;

Column 6, line 46, change "sidingly" to --slidingly--;

Column 7, line 60, change "supplied" to --supplies--;

Column 8, line 16, before "pneumatic" insert --said bearings, said biasing means comprising--;

Column 8, line 62, change "supplied" to --supplies--;

Column 10, line 13, change "mean" to --means--;

line 14, after "two" insert --different--.

Signed and Sealed this

Twenty-ninth Day of December, 1992

*Attest:*

DOUGLAS B. COMER

*Attesting Officer*

*Acting Commissioner of Patents and Trademarks*